United States Patent [19]

Yamaguchi et al.

[11] 4,362,144

[45] Dec. 7, 1982

[54] CONTACTLESS IGNITION SYSTEM FOR INTERNAL COMBUSTION ENGINE

[75] Inventors: Toshiyuki Yamaguchi, Okazaki; Hiroyuki Nobechi, Toyota; Yoshiaki Nakano, Gifu; Tiaki Mizuno, Toyota, all of Japan

[73] Assignee: Nippondenso Co., Ltd., Kariya, Japan

[21] Appl. No.: 227,249

[22] Filed: Jan. 22, 1981

[30] Foreign Application Priority Data

Jan. 24, 1980 [JP] Japan ..... 55-7077

[51] Int. Cl.[3] ..... F02P 3/04

[52] U.S. Cl. ..... 123/609; 123/644

[58] Field of Search ..... 123/609, 610, 644

[56] References Cited

U.S. PATENT DOCUMENTS

| | | | |
|---|---|---|---|
| 3,605,713 | 9/1971 | Le Masters et al. | 123/644 |
| 3,831,571 | 8/1974 | Weber | 123/644 X |
| 3,882,840 | 5/1975 | Adamian et al. | 123/644 |
| 3,937,193 | 2/1976 | Kim | 123/644 X |
| 4,167,927 | 9/1979 | Mikami et al. | 123/609 |
| 4,228,779 | 10/1980 | Wetzel | 123/644 X |

*Primary Examiner*—Tony M. Argenbright

*Attorney, Agent, or Firm*—Cushman, Darby & Cushman

[57] ABSTRACT

A contactless ignition system for an internal combustion engine comprises a signal generator generating an AC signal synchronously with the rotation of the engine, a resistor detecting primary current supplied to an ignition coil, a circuit detecting the rising time of the primary current until the primary current attains a predetermined level, and a circuit producing a signal proportional to the rotational speed of the engine. On the basis of the signal indicative of the rising time of the primary current supplied to the ignition coil and the signal proportional to the rotational speed of the engine, an off-time control signal for controlling the off-time of the ignition coil is generated in which the ratio between the duration of the primary current supplied to the ignition coil, being maintained at the predetermined level, and the ignition period is maintained constant. The off-time of the ignition coil is controlled only when the rotational period of the engine is shorter than a predetermined setting.

3 Claims, 4 Drawing Figures

CONTACTLESS IGNITION SYSTEM FOR INTERNAL COMBUSTION ENGINE

BACKGROUND OF THE INVENTION

This invention relates to a contactless ignition system provided with a dwell angle control device for igniting an internal combustion engine, especially, that used for driving an automotive vehicle.

A contactless ignition system of this kind is disclosed in, for example, U.S. Pat. No. 3,605,713. FIG. 1 shows the waveform of primary current $i_c$ supplied to the ignition coil in such a disclosed ignition system. The disclosed system includes closed-loop control means so that the primary current $i_c$ supplied to the ignition coil until immediately before the generating timing of spark ignition voltage across the ignition coil can be maintained at a predetermined current level $i_{co}$ for a controlled period of time $T_i$ of a predetermined value as shown in FIG. 1. When, for example, the period of time $T_i$ exceeds the predetermined value, the starting timing of primary current supply to the ignition coil is delayed so as to shorten the duration $T_{ON}$ of current supply to the ignition coil thereby maintaining the period of time $T_i$ at the predetermined value. Such a manner of feedback control is continuously carried out to control the duration $T_{ON}$ of primary current supply to the ignition coil, hence, to control the dwell time so that the period of time $T_i$ can always be stably maintained at the predetermined value.

In FIG. 1, $T_c=(T_{ON}-T_i)$ represents the period of time or rising time required for the primary current $i_c$ supplied to the ignition coil until it rises to its predetermined level $i_{co}$ from its zero level. It is known that the non-uniformity of inductance components of ignition coils within manufacturing tolerances, during manufacture of a lot of such coils, appears directly as a corresponding non-uniformity of the length of the rising time $T_c$. In the aforementioned prior art ignition system, a $T_i$ feedback function is provided for comparing the detected actual value of $T_i$ with its reference value $T_{io}$ so that the duration $T_{ON}$ of primary current supply to the ignition coil can be controlled depending on the error $\Delta T_i=T_i-T_{io}$. Thus, when, for example, the inductance of the ignition coil employed in the ignition system is lower by 10% than the designed setting, and consequently, the rising time $T_c$ is shorter by 10% than the designed setting, the duration $T_{ON}$ of primary current supply to the ignition coil must also be selected to be shorter by about 10% than the designed setting.

In the prior art control system, the duration $T_{ON}$ of primary current supply to the ignition coil is determined depending on the error $\Delta T_i=T_i-T_{io}$ regardless of the difference in the inductance of each ignition coil. Therefore, when the inductance of the ignition coil is lower than the designed setting due to the manufacturing tolerances, $T_c$ will become shorter and $T_i$ will become substantially longer within the determined duration $T_{ON}$ of primary current supply to the ignition coil. This means that excessive heat is generated in the output stage transistor and also in the ignition coil resulting in a great temperature rise of these elements. Because of such non-uniformity of the inductance, the heat radiating fins of the output stage transistor had to be sized to be considerably larger than the size calculated according to the indexes of standard heat generation in the contactless ignition system, resulting in a difficulty of attaining the desired miniaturization of the output stage transistor. When, on the other hand, the inductance of the ignition coil is higher than the designed setting, $T_c$ will become longer and $T_i$ will become substantially shorter within the determined duration $T_{ON}$ of primary current supply to the ignition coil. The ignition system including such an ignition coil has been defective in that the primary current $i_c$ supplied to the ignition coil will not attain the predetermined level $i_{co}$ in a worst case resulting in impossibility of exhibition of the desired spark ignition performance.

SUMMARY OF THE INVENTION

With a view to obviate such prior art defects, it is a primary object of the present invention to provide a novel and improved contactless ignition system for an internal combustion engine, in which the rising time $T_c$ of the primary current $i_c$ supplied to the ignition coil is continuously detected by means of a current detecting resistor continuously detecting the primary current $i_c$ being supplied to the ignition coil thereby controlling the dwell angle of the ignition coil, and which thus establishes the predetermined constant current time $T_i$ during which the primary current $i_c$ is maintained at its predetermined value, thereby ensuring exhibition of the desired stable spark ignition performance in any one of the engine rotation speed ranges regardless of a deviation of the inductance of the ignition coil from the designed setting due to the manufacturing tolerances and other factors.

Another object of the present invention is to provide a contactless ignition system of the above character in which, when the ignition period is longer than a predetermined setting and the angular rotation position signal itself providing the ignition timing can be directly used for the on-off of the primary current $i_c$ supplied to the ignition coil to ensure exhibition of the desired spark ignition performance, the dwell angle control function controlling the dwell angle of the ignition coil is disabled so that the dwell angle control may not be carried out when noises having a period longer than a predetermined setting may appear in the input for some reasons regardless of stoppage of the engine, whereby the primary current $i_c$ supplied to the ignition coil may not become large enough to induce the spark ignition voltage when interrupted, and the sparks may not be produced at erroneous timing.

Still another object of the present invention is to provide a contactless ignition system of the above character in which, when the ignition period is shortened to less than the predetermined setting, the dwell angle control is started with a delay time corresponding to the rate of variation of the ignition period so that, when the value of the ignition period is close to a critical point of switch-over between execution and non-execution of the dwell angle control, intermittent on-off of the dwell angle control function across the critical point due to the presence of noises or any other spurious components in the input may be reliably prevented, whereby the dwell angle control can be stably carried out.

The contactless ignition system according to the present invention is featured by the fact that the rising time $T_c$ of the primary current $i_c$ supplied to the ignition coil is detected so as to control the dwell angle of the ignition coil. Therefore, the duty ratio Ti/T of the period of time $T_i$, during which the primary current $i_c$ is maintained at its predetermined level $i_{co}$ (the constant current time of current supply to the output stage transistor), to the ignition period T can be controlled to be maintained constant so as to minimize the quantity of heat generated in the output stage transistor and in the ignition coil. Further, due to the fact that the primary current $i_c$ supplied to the ignition coil attains the predetermined constant level $i_{co}$ in any one of the engine rotation speed ranges, the desired stable spark ignition performance can be exhibited at all the speeds. Furthermore, the contactless ignition system according to the present invention comprising the current detecting resistor detecting the rising time $T_c$ of the primary current $i_c$ supplied to the ignition coil is advantageous in that the duty ratio $T_i/T$ of the period of time (the constant current time) $T_i$, during which the primary current $i_c$ is maintained at its predetermined level $i_{co}$, to the ignition period T can be controlled to be a constant $K_1$ regardless of a deviation of the rising time $T_c$ from its designed setting due to a deviation of the inductance of the ignition coil owing to the manufacturing tolerances.

The contactless ignition system according to the present invention is further advantageous in that the dwell angle control function is disabled when the ignition period exceeds a predetermined setting, so as to prevent malfunctioning of the ignition system due to the appearance of noises whose period is longer than the setting of the ignition period. The contactless ignition system according to the present invention is further advantageous in that the dwell angle control is started with a delay time corresponding to the rate of variation of the ignition period so as to prevent intermittent on-off of the dwell angle control function across a critical switch-over point which represents the value of the ignition period at which the dwell angle control is to be started.

DESCRIPTION OF THE PREFERRED EMBODIMENT

Figure 2:
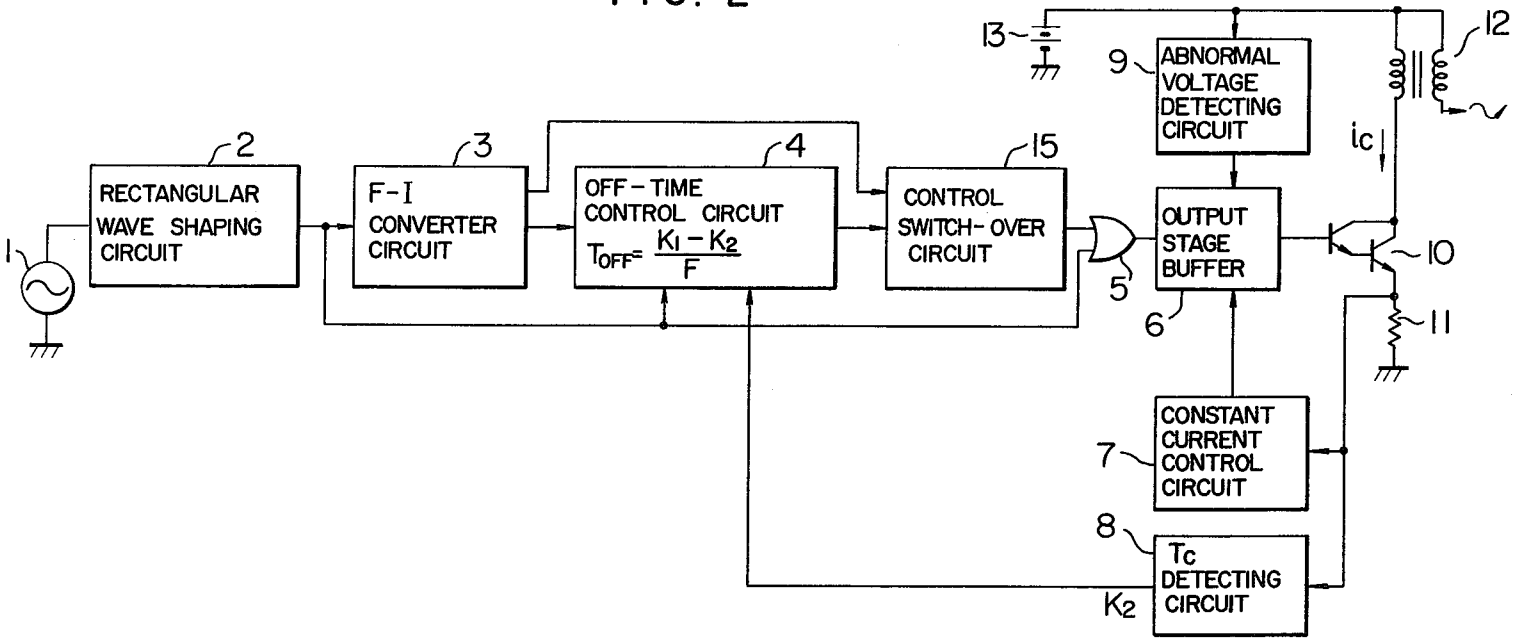
FIG. 2 is a block diagram of a preferred embodiment of the contactless ignition system according to the present invention.

A preferred embodiment of the present invention will now be described in detail with reference to the drawings. FIG. 2 is a block diagram of a preferred embodiment of the contactless ignition system for an internal combustion engine according to the present invention, and the outline of the system embodying the present invention will be described with reference to FIG. 2. Referring to FIG. 2, a known AC generator 1 rotating in synchronism with an internal combustion engine applies its AC output to a rectangular wave shaping circuit 2. The AC output is as is well known proportional in frequency to the rotational speed of an engine and is advanced or retarded in phase to change the ignition timing in accordance with engine operating conditions. The rectangular waveform output from the rectangular wave shaping circuit 2 is applied to a frequency-current (F−I) converter circuit 3 which generates an output current I corresponding to the frequency F of the input. The rectangular waveform output from the rectangular wave shaping circuit 2 is also applied to an off-time ($T_{OFF}$) control circuit 4 and to an OR circuit 5. The output current I generated from the F−I converter circuit 3 is supplied to the off-time control circuit 4 and to a control switch-over circuit 15. The off-time control circuit 4 generates an output signal for controlling the off-time $T_{OFF}$ of primary current $i_c$ supplied to an ignition coil 12 depending on the level of the output current I from the F−I converter circuit 3, and such an output signal is applied to the control switch-over circuit 15. This control switch-over circuit 15 functions to permit or inhibit transmission of the output signal from the off-time control circuit 4 to the OR circuit 5 depending on the level of the output current I generated from the F−I converter circuit 3, hence, depending on the frequency F of the rectangular waveform output from the rectangular wave shaping circuit 2. The OR circuit 5 generates an output signal representing the logical sum of the output from the rectangular wave shaping circuit 2 and the output from the control switch-over circuit 15, and such a logical-sum output signal is applied through an output stage buffer 6 to trigger an output stage transistor 10 which acts as a means for interrupting the primary current $i_c$ supplied to the ignition coil 12.

The operation of the contactless ignition system embodying the present invention will now be described in detail. At first, discussion will be made on how the off-time $T_{OFF}$ should be controlled for controlling the dwell angle in order to achieve an optimum spark ignition performance. It is the purpose of the dwell angle control in the internal combustion engine that the primary current $i_c$ supplied to the ignition coil 12 attains its predetermined constant level $i_{co}$ to ensure a stable spark ignition performance in any one of the engine rotation speed ranges. Generation of heat in the output stage transistor 10 occurs necessarily throughout the period of time $T_i$ during which the transistor 10 operates in its active region with the primary current $i_c$ being maintained at the predetermined level $i_{co}$. Therefore, the output stage transistor 10 undergoes a temperature rise which is substantially proportional to the ratio $T_i/T$ between the constant current time $T_i$ and the ignition period T between two successive ignitions. Thus, when the constant current time $T_i$ is excessively long, the temperature rise of the output stage transistor 10 becomes so excessive that the transistor 10 will be finally destroyed. It is therefore desirable to maintain the ratio $T_i/T$ at an appropriate value in any one of the engine rotation speed ranges. In a numerical expression, the dwell angle control is a manner of control which establishes and maintains the relation $T_i/T=K_o$, where $K_o$ is a constant. The value of $K_o$ is generally set at $K_o \approx 0.01$ to 0.1 and is preferably as small as possible.

Figure 1:
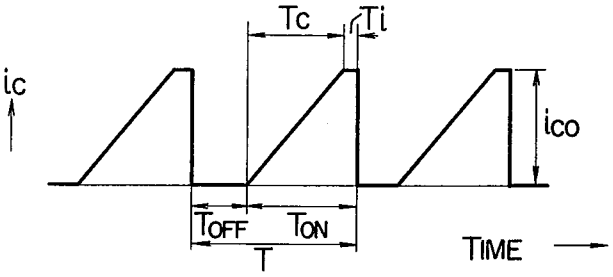
FIG. 1 PRIOR ART
FIG. 1 shows the waveform of primary current supplied to the ignition coil in the prior art contactless ignition system which can also be used in the explanation of the system of the present invention.

How the off-time $T_{OFF}$ should be controlled to maintain constant the ratio $T_i/T$ will be discussed with reference to FIG. 1. Referring to FIG. 1, $T_{OFF}$ is given by $$T_{OFF} = T - T_c - T_i = T\left(1 - \frac{T_c}{T} - \frac{T_i}{T}\right)$$

In the above equation, T is the reciprocal of the number of revolutions F of the engine per unit time and is thus expressed as $T=1/F$. Since $T_i/T=K_o$ which is a constant, $(1-T_i/T)$ is also a constant and is now expressed as $(1-T_i/T)=(1-K_o)=K_1$. Let the variable $T_c/T$ be $K_2$, then, $T_{OFF}$ can be expressed as $$T_{OFF}=(K_1-K_2)/F$$

In the present invention, the primary current $i_c$ supplied to the primary winding of the ignition coil 12 is detected by a current detecting resistor 11, and a train of pulses each indicative of the rising time $T_c$ are generated from a rising time ($T_c$) detecting circuit 8 so that an information signal indicative of $K_2=T_c/T$ can be applied to the off-time control circuit 4. This off-time control circuit 4 comprises a monostable multivibrator which provides an output signal indicative of $T_{OFF}=(K_1-K_2)/F$ for controlling the off-time $T_{OFF}$. As a result, the dwell angle is so controlled as to satisfy the relation $T_i/T=K_o$, thereby minimizing generation of heat in the output stage transistor 10. Therefore, the primary current $i_c$ attains the predetermined current level $i_{co}$ in any one of the engine rotation speed ranges, thereby ensuring exhibition of a stable spark ignition performance at all the speeds. In the present invention, the rising time $T_c$ of the primary current $i_c$ supplied to the ignition coil 12 is detected to determine the off-time $T_{OFF}$ on the basis of which the dwell angle is controlled. Therefore, the ratio $T_i/T=K_o$ can be maintained constant regardless of a deviation of the inductance of the ignition coil 12 in use from the designed setting.

The rising time $T_c$ of the primary current $i_c$ supplied to the ignition coil 12 is also variable depending on the power supply voltage supplied from a battery 13, and in the prior art, a function related to variations of the power supply voltage affecting the dwell angle control had to be used for compensating variations of the power supply voltage, if any. In the present invention, $T_c$ is detected by the $T_c$ detecting circuit 8, and the signal indicative of the detected actual value of $T_c$ is applied from the circuit 8 to the off-time control circuit 4. The present invention has therefore the advantage that a circuit for compensating variations of the power supply voltage is utterly unnecessary, and the relation $T_i/T=K_o$ can be always ensured in a strict sense. Further, due to the fact that the frequency range F and the type of the ignition coil 12 employed in an internal combustion engine differ from those in another engine depending on the number of cylinders thereof, it has been necessary to alter the time constant of the dwell angle control means in the prior art contactless ignition system. In sharp contrast to the prior art, the operating frequency range F and the rising time $T_c$ of the primary current $i_c$ supplied to the ignition coil 12 are detected in the present invention for the purpose of the dwell angle control. The present invention, therefore, provides such an additional advantage that the same contactless ignition system can be used, without any structural alteration, for the control of a variety of engines having different numbers of cylinders, and because of this advantage, the ignition system can be mass-produced at low cost.

The output from the off-time control circuit 4 in the ignition system having the aforementioned advantages is applied through the control switch-over circuit 15, OR circuit 5 and output stage buffer 6 to the output stage transistor 10 to control the dwell angle in the ranges of intermediate and high rotation speeds of the engine. An abnormal voltage detecting circuit 9 shown in FIG. 2 is provided to turn off the output stage transistor 10 in the event in which the power supply voltage of the battery 13 becomes unusually high.

Figure 3:
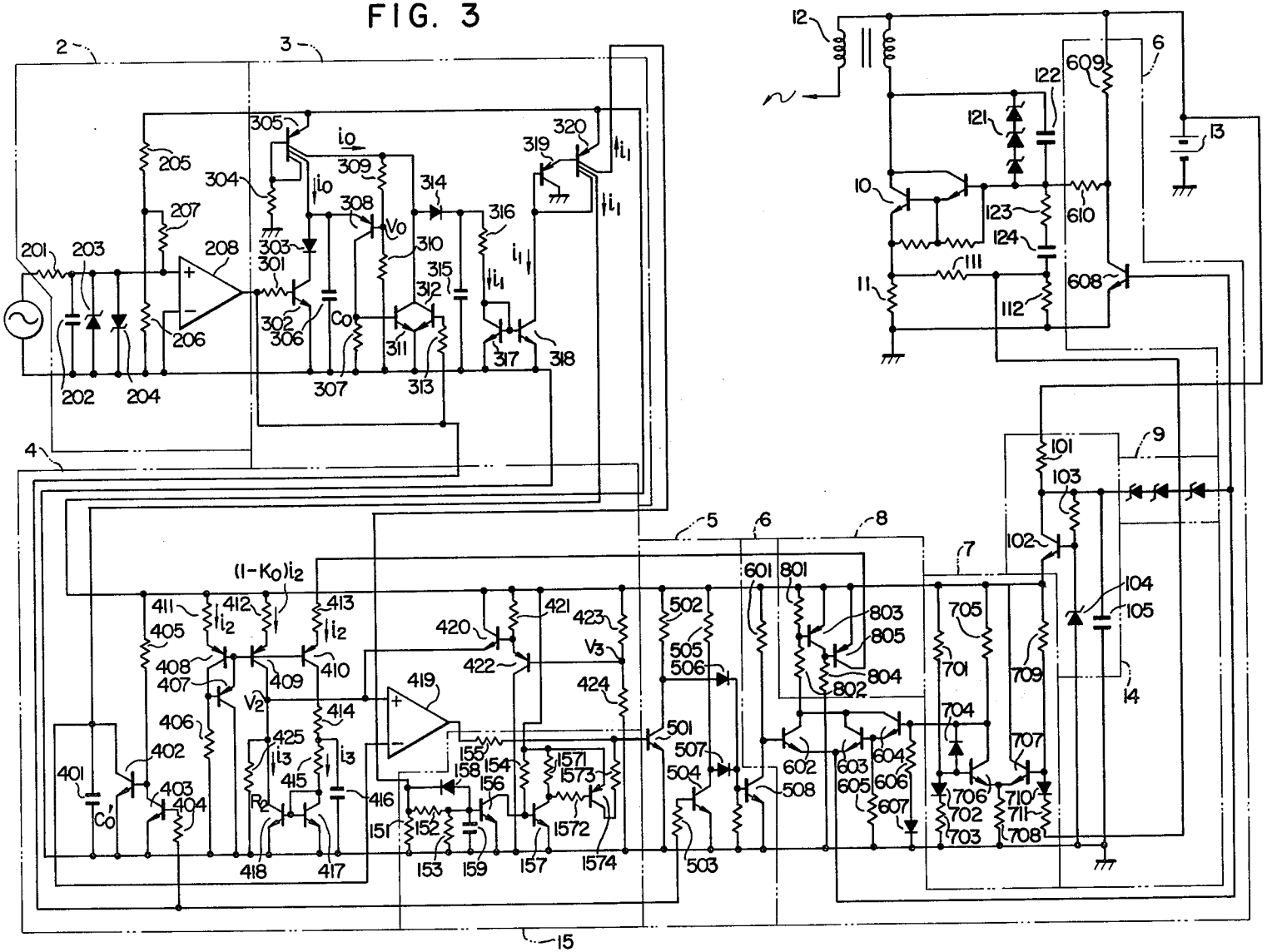
FIG. 3 is a detailed electrical circuit diagram of the system shown in FIG. 2.
Figure 4:
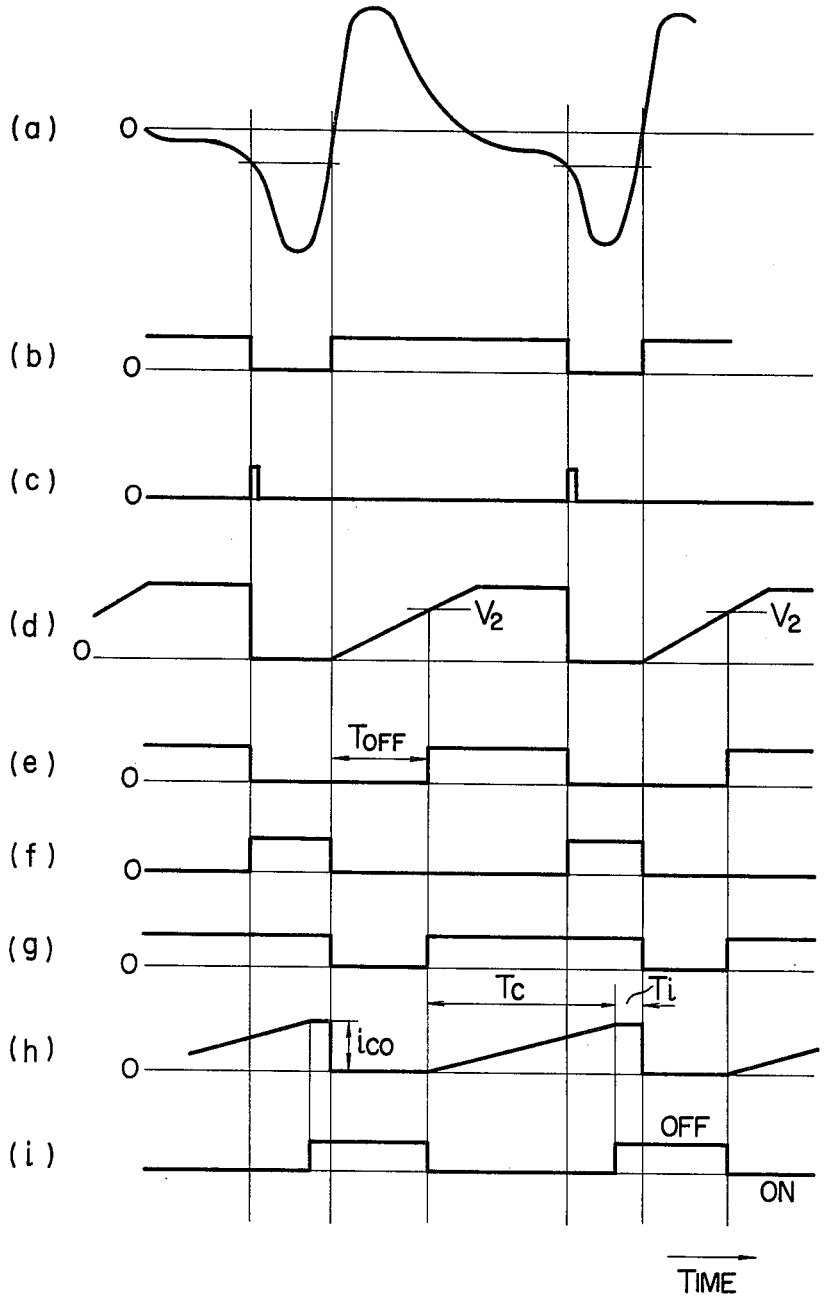
FIG. 4 shows various signal waveforms to illustrate the operation of the system shown in FIG. 3.

The detailed circuit structure of the ignition system of FIG. 2 is shown in FIG. 3, and signal waveforms appearing at various portions in FIG. 3 are shown in FIG 4. The AC generator 1 generates an AC output signal having a waveform as shown in (a) of FIG. 4 to determine the ignition timing depending on the factors including, for example, the engine rotation speed and the intake manifold vacuum. This AC output signal is applied to the rectangular wave shaping circuit 2 in which resistors 201, 205, 206 and 207 determine the threshold level and the resultant signal passes through a comparator 208 to appear as a rectangular waveform as shown in (b) of FIG. 4. The rising edge of this rectangular waveform indicates the ignition timing (the timing of interrupting the primary current $i_c$ supplied to the ignition coil 12) as described later. A capacitor 202 and Zener diodes 203, 204 are provided for eliminating noises and protecting the comparator 208 against malfunctions. In the range of low rotational speeds such as the idling rotational speed of the engine, the output signal of rectangular waveform from the rectangular wave shaping circuit 2 is applied through resistors 503, 505, transistors 504, 508 and a diode 507 in the OR circuit 5 to resistors 601, 609, 610 and transistors 602, 608 in the output stage buffer 6 to drive the output stage transistor 10.

The F−I converter circuit 3 comprises a constant current source (whose constant current value is $i_o$) composed of a resistor 304 and a multi-collector transistor 305; a reference voltage source (whose reference voltage is $V_o$) composed of resistors 309 and 310; a capacitor 306 (whose capacitance value is $C_o$); an output current generating circuit composed of a capacitor 315, a resistor 316 and transistors 317, 318, 319, 320; and a switching circuit composed of resistors 301, 307, 313, transistors 302, 308, 311, 312 and diodes 303, 314. When the output signal from the comparator 208 in the rectangular wave shaping circuit 2 turns into its "0" level, the transistors 302 and 312 in the F−I converter circuit 3 are turned off. As soon as the transistor 302 is turned off, the capacitor 306 is charged with the constant current $i_o$, and when the voltage charged across this capacitor 306 exceeds the reference voltage $V_o$ determined by the resistors 309 and 310, the transistor 308 is turned on to turn on the transistor 311. Then, when the output signal from the comparator 208 in the rectangular wave shaping circuit 2 turns into its "1" level from its "0" level, the transistors 302 and 312 are turned on in the F−I converter circuit 3. Since the transistor 302 is now turned on, the charge stored in the capacitor 306 is instantaneously discharged, and the transistors 308 and 311 are turned off. Consequently, a signal of "1" level having a constant pulse width determined by $(C_o \cdot V_o)/i_o$ as shown in (c) of FIG. 4 appears at the common-connected collectors of the transistors 311 and 312 each time the output signal from the comparator 208 turns into its "0" level from its "1" level. Since the capacitor 315 is continuously charged with the constant current $i_o$ during the constant period of time of $(C_o \cdot V_o)/i_o$ during which the signal appearing at the common-connected collectors of the transistors 311 and 312 remains in its "1" level, the voltage charged across this capacitor 315 corresponds to the frequency of the output signal from the comparator 208, hence, to the rotational speed F of the engine, and an output current proportional to the voltage charged across the capacitor 315 passes through the transistors 317, 318 and 319 to appear at the collector of the transistor 320. The output current appearing from the F−I converter circuit 3 is now designated by $i_1$. Then, from the relation between the charge current and the discharge current of the capacitor 315, the following equations are obtained:

$$(C_o \cdot V_o)/i_o \cdot i_o = T \cdot i_1$$

(where T is the pulse period of the output from the comparator 208.)

$$i_1 = (C_o \cdot V_o)/T = C_o \cdot V_o \cdot F$$

(where F is the pulse frequency of the output from the comparator 208.)

The off-time control circuit 4 comprises a monostable multivibrator circuit which generates a signal indicative of the off-time $T_{OFF} = (K_1 - K_2)/F$ in response to the supply of the current $i_1$ proportional to the engine rotation speed F from the F−I converter circuit 3. The off-time control circuit 4 includes a constant current generating circuit composed of resistors 406, 411, 412, 413, 414, 415, 425, transistors 407, 408, 409, 410, 417, 418 and a capacitor 416. This constant current generating circuit is so designed that a current $i_2$ flows through the resistor 411, and a current given by $(1-K_o) \cdot i_2 = K_1 \cdot i_2$ flows through the resistor 412. A transistor 805 in the $T_c$ detecting circuit 8 is so arranged that it is turned on and kept in that state during only the rising time $T_c$ of the primary current $i_c$ supplied to the ignition coil 12, and the current $i_2$ flows through the resistor 413 in the on-state of the transistor 805. At this time, a current $i_3$ flows through the resistor 415. From the relation between the charge current and the discharge current of the capacitor 416, the following equation holds:

$$T_c \cdot i_2 = T \cdot i_3$$

$$i_3 = T_c/T \cdot i_2 = K_2 \cdot i_2$$

The same current $i_3$ flows as the collector current of the transistor 418. Therefore, a voltage $V_2$ given by $V_2 = R_2 \cdot (K_1 \cdot i_2 - i_3) = R_2 \cdot i_2 (K_1 - K_2)$ (where $R_2$ is the resistance value of the resistor 425) is applied to the non-inverted input terminal of a comparator 419.

The output signal from the comparator 208 in the rectangular wave shaping circuit 2 is also applied through the resistors 404, 405 and the transistor 403 to turn on and off the transistor 402 in the off-time control circuit 4. When this transistor 402 is turned on, the charge stored in the capacitor 401 is instantaneously discharged, while when the transistor 402 is turned off, the capacitor 401 is charged with the constant current $i_1 (= C_o \cdot V_o \cdot F)$ supplied from the F−I converter circuit 3. Consequently, a generally triangular output waveform as shown in (d) of FIG. 4 appears from the capacitor 401 which has a capacitance value $C_o'$. Since such a voltage is applied from the capacitor 401 to the inverted input terminal of the comparator 419, the off-time $T_{OFF}$ indicated by the output signal from the comparator 419 is given by $$T_{OFF} = \frac{C_o' \cdot V_2}{i_1} = \frac{C_o' \cdot R_2 \cdot i_2 (K_1 - K_2)}{C_o \cdot V_o \cdot F}$$

Suppose that $C_o \approx C_o'$, then, $T_{OFF}$ is expressed as $$T_{OFF} = \frac{R_2 \cdot i_2}{V_o} \cdot \frac{K_1 - K_2}{F}$$

In the contactless ignition system performing the above manner of control, the dwell angle can be controlled so as to maintain the relation $T_i/T = K_o$, where $K_o$ is the constant provided by the ratio between the resistance values of the resistors 411 and 412, and the heat generated in the output stage transistor 10 can be minimized. Further, the primary current $i_c$ supplied to the ignition coil 12 attains the predetermined constant current level $i_{co}$ in the ranges of intermediate and high rotational speeds of the engine so that the desired stable spark ignition performance can be exhibited at these speeds. It is the function of the transistor 420, 422 and resistors 421, 423, 424 that a voltage $V_3$ determined by the resistors 423 and 424 provides a minimum voltage $V_{2MIN}$ applied to the noninverted input terminal of the comparator 419. Thus, $T_{OFFMIN}$ is given by $$T_{OFFMIN} = \frac{C_o' \cdot V_3}{i_1}$$

$$\frac{T_{OFFMIN}}{T} = \frac{C_o' \cdot V_3}{C_o \cdot V_o \cdot F \cdot T} = \frac{V_3}{V_o} = \text{a constant}$$

It will thus be seen that a limit is provided for the maximum dwell angle so that the dwell angle may not become excessively large even in the presence of, for example, noises.

The output signal from the off-time control circuit 4 is applied to the OR circuit 5 through a resistor 155 in the control switch-over circuit 15, and the output current $i_1$ supplied from the F−I converter circuit 3 flows through a resistor 151 composing a shunt circuit and also through resistors 152 and 153 acting as a voltage dividing means. The output current $i_1$ supplied from the F−I converter circuit 3 is small and the voltage across the resistor 151 is low when the frequency or engine rotational speed F is low. Since, in such a case, the voltage divided by the voltage-dividing resistors 152 and 153 is not high enough to turn on a transistor 156, another transistor 157 is turned on by the base current supplied through a resistor 154, and a "0" level appears at the connection point between resistors 1571 and 1572. A transistor 1574 is therefore turned on. Since a signal of "1" level is applied through a resistor 1573 to the base of a transistor 501 in the OR circuit 5, the output signal from the off-time control circuit 4 is not transmitted to the OR circuit 5. When, on the other hand, the frequency or engine rotation speed F is sufficiently high, the value of the output current $i_1$ is large, and the voltage across the resistor 151 is high. Since, in such a case, the voltage divided by the voltage-dividing resistors 152 and 153 is also high enough to turn on the transistor 156, the transistors 157 and 1574 are turned off, and the output signal from the off-time control circuit 4 is transmitted through the resistor 155 to the OR circuit 5. In this latter case, the output signal from the off-time control circuit 4 is applied through transistors 501, 508, a resistor 502 and a diode 506 in the OR circuit 5 to resistors 601, 609, 610 and transistors 602, 608 in the output stage buffer 6 to drive the output stage transistor 10. The capacitor 401 in the off-time control circuit 4 is not charged while the output signal from the comparator 208 remains in its "0" level. Consequently, a collector signal, which takes its "0" level during the period of time of the sum of the "0" level duration of the output signal from the comparator 208 and the off-time $T_{OFF}$ as shown in (e) of FIG. 4, appears at the collector of the transistor 501 in the OR circuit 5. A collector signal which takes its "1" level during the "0" level duration of the output signal from the comparator 208 as shown in (f) of FIG. 4, appears at the collector of the transistor 504 in the OR circuit 5. The diodes 506 and 507 act as an OR gate for the collector signals of the transistors 501 and 504, so that a signal having a waveform as shown in (g) of FIG. 4 is applied to the base of the transistor 508. Since the output stage transistor 10 is finally triggered by the signal having the waveform shown in (g) of FIG. 4, the collector current of the output stage transistor 10, hence, the primary current $i_c$ supplied to the primary winding of the ignition coil 12 has a waveform as shown in (h) of FIG. 4. It will be seen from (h) of FIG. 4 that the off-time $T_{OFF}$ of the primary current $i_c$ supplied to the primary winding of the ignition coil 12 is controlled in the manner above described.

The primary current $i_c$ supplied to the primary winding of the ignition coil 12 flows through the current detecting resistor 11, and a voltage having a level corresponding to the detected primary current value is generated across this resistor 11. This voltage is applied through resistors 111 and 112 to the constant current control circuit 7. This constant current control circuit 7 comprises a differential amplifier composed of resistors 701, 703, 705, 708, 709, 711, diodes 702, 704, 710 and transistors 706, 707. In the constant current control circuit 7, the resistors 701, 703 and diode 702 establish a reference voltage, and the voltage having the level corresponding to the detected primary current value is applied to the diode 170. An output signal representing the difference between the above voltages appears at the collector of the transistor 706. Depending on the level of this collector output from the transistor 706, the combination of transistor 603, 604, resistors 605, 606 and a diode 607 in the output stage buffer 6 acts to increase the base current supplied to the transistor 608 so that, so soon as the value of the primary current $i_c$ exceeds the predetermined setting $i_{co}$, the operating region of the output stage transistor 10 is shifted to the unsaturated region or active region, thereby limiting the maximum value of the primary current $i_c$ to the predetermined setting $i_{co}$. The output stage transistor 10 interrupts the flow of the primary current $i_c$ to the primary winding of the ignition coil 12 in synchronism with the rise time of the output (shown in (b) of FIG. 4) from the wave shaping circuit 2, thereby inducing a spark voltage across the secondary winding of the ignition coil 12.

The $T_c$ detecting circuit 8 is composed of resistors 801, 802, 804 and transistors 803, 805. During the off-time $T_{OFF}$ in which the transistor 602 is in its on-state since the base potential of the transistor 508 is in its "0" level, and during the period of time in which the transistor 603 is operating in the unsaturated region since the value of the primary current $i_c$ exceeds the predetermined setting $i_{co}$, the transistor 803 is turned on to turn off the transistor 805 and remains in that state. During the other period of time, the transistor 803 is turned off to turn on the transistor 805 and remains in that state. FIG. 4 shows in (i) the on-off waveform of this transistor 805. It will be seen from (i) of FIG. 4 that the transistor 805 is turned on as soon as the supply of the primary current $i_c$ to the primary winding of the ignition coil 12 is started, and it is kept in that state for the period of time $T_c$ at the end of which the primary current $i_c$ attains the predetermined level $i_{co}$.

The control switch-over circuit 15 includes a capacitor 159 which, when noise is mixed in the input to, for example, the rectangular wave shaping circuit 2 etc. and a high frequency is suddenly detected in the input frequency which should be primarily low, acts to delay the switch-over starting timing with a CR time constant so that the dwell angle control may not immediately take place. The CR time constant above described is determined by the capacitance value of the capacitor 159 and the resistance values of the resistors 151, 152 and 153. A diode 158 in the control switch-over circuit 15 acts to cause discharge of the charge stored in the capacitor 159 when the frequency F changes from its high level to a low level, thereby immediately turning off the transistor 156 and turning on the transistor 157 so that the output signal from the off-time control circuit 4 may not be applied to the OR circuit 5 in such a case.

A constant voltage circuit 14 is composed of resistors 101, 103, a transistor 102, a Zener diode 104 and a capacitor 105. This circuit 14 is provided to stabilize the power supply voltage of the battery 13 so that a constant voltage can be applied to the individual circuits.

The abnormal voltage detecting circuit 9 is composed of three Zener diodes connected in series with each other. In the event in which the power supply voltage of the battery 13 becomes unusually high or exceeds a predetermined level, all of the Zener diodes conduct to supply the base current to the transistor 608 in the output stage buffer 6, thereby turning on the transistor 608 to turn off the output stage transistor 10.

A plurality of Zener diodes 121 are connected in series across the base and the collector of the output stage transistor 10 so that, when a surge voltage induced in the primary winding of the ignition coil 12 exceeds a predetermined setting, the output stage transistor 10 is turned on, and such a surge voltage can be absorbed by the diodes. Capacitors 122, 124 and a resistor 123 are also provided to prevent oscillation of the output stage transistor 10.

In the aforementioned embodiment of the present invention, the output signal from the rectangular wave shaping circuit 2 is applied to the F−I converter circuit 3 to provide an output current $i_1$ proportional to the rotation speed F of the engine. However, the elements 301 to 313 in the F−I converter circuit 3 may be eliminated, and the AC output of the AC generator 1 may be directly connected through a resistor (not shown) to the anode of the diode 314. In this modification, the AC output from the AC generator 1 is directly rectified and smoothed by the combination of the diode 314 and the capacitor 315 to provide similarly the output current $i_1$ proportional to the rotational speed F of the engine.

Also, in the aforementioned embodiment of the present invention, the AC output from the AC generator 1 is shaped into a rectangular waveform by the rectangular wave shaping circuit 2. However, a rectangular waveform generating circuit including an element such as a Hall element or a phototransistor generating a rectangular pulse signal in synchronism with the rotation of the engine may be employed to eliminate both of the AC generator 1 and the rectangular wave shaping circuit 2.

Further, in the aforementioned embodiment, the maximum value of the primary current $i_c$ is limited to a predetermined setting $i_{co}$ by the constant current circuit 7. However, according to the principle of the present invention, the rising time $T_c$ of the primary current $i_c$ from the current supply starting time to the time of attainment of its predetermined setting $i_{co}$ is detected for control purpose. Therefore, when the time of attainment of the predetermined setting $i_{co}$ of the primary current $i_c$ is selected to substantially coincide with the ignition timing, the maximum value of the primary current $i_c$ need not necessarily be limited to such a predetermined setting $i_{co}$.

As described in detail hereinbefore, the present invention is featured by the fact that the rising time $T_c$ of the primary current $i_c$ is detected to control the dwell angle of the ignition coil 12. Although the off-time control circuit 4 generating an output pulse indicative of $(K_1-K_2)/F$ is employed for the control of the dwell angle, it may be replaced by a modified off-time control circuit adapted for calculating the off-time on the basis of another way of calculation. Further, the on-time itself of the primary current $i_c$ supplied to the ignition coil 12 may be directly controlled on the basis of the detected rising time $T_c$ for the control of the dwell angle.

In the aforementioned embodiment, the threshold level of the switch-over control by the control switch-over circuit 15 is determined depending on the base-emitter voltage of the transistor 156. However, a satisfactorily accurate reference voltage source and a comparator may be used to eliminate an adverse effect due to, for example, a temperature change. Further, the voltage across the resistor 151 may be differentiated to detect the rate of variation of the frequency F so that, when the rate of variation of the frequency F exceeds a predetermined value, the transistor 157 may be turned on to prevent the dwell angle control from being carried out in the presence of high frequency noise in the input to the control switch-over circuit 15. Although the control switch-over circuit 15 is connected between the off-time control circuit 4 and the OR gate 5 in the aforementioned embodiment, the control switch-over circuit 15 may be incorporated in the off-time control circuit 4. For example, the control switch-over circuit 15 may be inserted in the signal path leading to the inverted input terminal of the comparator 419 in the off-time control circuit 4 to inhibit or stop the off-time control function itself of the off-time control circuit 4.

We claim:

1. A contactless ignition system for an internal combustion engine comprising:

an ignition coil including a primary winding and a secondary winding;

semiconductor switching means connected to the primary winding of said ignition coil for controlling the primary current supply through the primary winding of said ignition coil;

current detecting means connected to said switching means for detecting the level of primary current supplied to the primary winding of said ignition coil;

a rising time detecting circuit connected to said current detecting means for detecting the rising period of time of the primary current until the level of the primary current attains a predetermined setting after the primary current starts to be supplied to the primary winding of said ignition coil, thereby generating a signal indicative of the rising time of the primary current;

means for generating a rectangular waveform signal having a period synchronized with the rotational period of the engine;

means for generating a current proportional to the rotational speed of the engine;

an off-time control circuit producing, on the basis of said current proportional to the rotational speed of the engine and said rising-time indicative signal, an off-time control signal for controlling the off-time of said ignition coil and to provide dwell angle control;

a control switch-over circuit gating said off-time control signal only when the engine rotation period indicated by the level of said current proportional to the rotational speed of the engine is shorter than a predetermined setting; and an OR circuit controlling the off-time of said switching means on the basis of the logical sum of the output signal from said control switch-over circuit and said rectangular waveform signal.

2. A contactless ignition system for an internal combustion engine as claimed in claim 1, wherein said control switch-over circuit starts to gate said off-time control signal with a delay time when the ignition period is shorter than said predetermined setting, while it acts to cease the dwell angle control immediately when the rotational period is longer than said predetermined setting.

3. A contactless ignition system for an internal combustion engine as claimed in claim 1 or 2, wherein said off-time control signal generated from said off-time control circuit is such that there is a constant ratio between the period of time, in which the primary current supplied to said ignition coil attains and remains in a predetermined level, and the ignition period.

* * * * *